US005188325A

United States Patent [19]

Hilty et al.

[11] Patent Number: 5,188,325

[45] Date of Patent: Feb. 23, 1993

[54] CLOTHING SUSPENSION APPARATUS

[75] Inventors: Calvin A. Hilty, Strathmore, Calif.; Larry J. Raid, Denmark, Iowa; George G. Grigel, Grafton, Wis.

[73] Assignee: Calvin's Cap Racks, Strathmore, Calif.

[21] Appl. No.: 662,849

[22] Filed: Mar. 1, 1991

[51] Int. Cl.[5] ..... A47F 7/00

[52] U.S. Cl. ..... 248/224.4; 211/30; 211/32

[58] Field of Search ..... 248/244.4, 309.1, 316.1, 248/316.7; 211/30, 32

[56] References Cited

U.S. PATENT DOCUMENTS 853,051 5/1907 Alson .
1,257,406 2/1918 Sauerman .
2,519,987 8/1950 Wernette .
2,765,509 10/1956 Brehm .
2,994,437 8/1961 Nyitrai .
3,192,894 8/1963 Staver .
3,322,381 4/1966 Bubb .
3,393,888 7/1968 Henningsgard .
3,521,332 7/1970 Kramer .
3,531,072 9/1970 Lindquist .
4,292,714 10/1981 Walker .
4,534,530 8/1985 Danko ..... 248/224.4
4,605,190 8/1986 Kemp .
4,673,153 6/1987 Hilty .

*Primary Examiner*—Robert W. Gibson, Jr.
*Attorney, Agent, or Firm*—Godfrey & Kahn

[57] ABSTRACT

A cap suspension apparatus (20) includes an elongated support member (22) and a plurality of cap engagement assemblies (24). The support member (22) is arranged to be releasably interconnected in series with another support member of similar construction. Each of the cap engagement assemblies (24) is rotatably borne by the support member (22) and operable to slidably receive a button (74) or other respective part of a cap (76) thereby supporting the cap (76) in an adjustable orientation relative to the support member (22).

22 Claims, 4 Drawing Sheets

CLOTHING SUSPENSION APPARATUS

BACKGROUND OF THE INVENTION

1. Field of the Invention

The present invention relates to an apparatus for suspending an article of clothing, and the like, from a supporting structure, and more particularly to an apparatus operable to deploy a plenary number of caps in an appropriate attitude to permit the brow portions thereof to be exposed for purposes of display.

2. Description of the Prior Art

In the last decade it has become quite popular for businesses and a variety of other organizations, to advertize their products or services by printing their groups slogans, trademarks, advertisements or messages onto the brow portion of lightweight, baseball-type caps and thereafter distribute, or sell these caps to their individual members or customers. This form of advertisement, for example, has become quite popular with respect to college and professional athletic teams, especially professional baseball and football franchises.

Recently, it has become quite popular for sports enthusiasts, and others, to collect these baseball caps, adorned with their sundry advertising slogans and designs and thereafter to hold them for purposes of display. Until quite recently, no convenient and inexpensive method had been devised to display these cap collections apart from the obvious method of constructing shelves which are somewhat expensive to purchase and usually require time-consuming installation.

Attempts have been made in the prior art to manufacture devices operable to deploy various caps and assorted headware for purposes of display and sale. For example U.S. Pat. No. 4,673,153 to Hilty, et al. discloses a clothing suspension apparatus which is operable for supporting a plurality of caps. In this regard this clothing suspension apparatus includes a substantially elongated support member and a plurality of button engagement assemblies. Each of these button engagement assemblies is supported in a predetermined orientation, by the support member, and is operable to slidably receive a button affixed on the crown portion of a cap for suspending the cap thereof. This cap suspension apparatus possesses numerous advantages over the previous prior art practices and related devices. For instance, several prior art patents have shown devices with frame like members adapted to hold a derby-like hat in such a manner that the caps can be conveniently stacked within each other on a display case for sale.

Other attempts in the prior art to provide devices adapted to deploy various garments such as headware have included, for example, U-shaped spring-biased hat rim engaging members which are operable to engage the hat rim and thereby cause the deployment of the remainder of the cap in an appropriate attitude.

While the prior art devices including that disclosed in the Hilty et al. reference have operated with varying degrees of success, they are unsatisfactory in one or more respects. For example, some of the prior art devices are cumbersome, difficult to retain in position and do not admit to convenient, easy deployment in confined quarters, for instance. Others, either do not admit to convenient deployment of baseball-type caps or are otherwise oversized and unsightly in use. Furthermore, some of these devices can only be employed by the use of a permanent fixture or specially adapted mounting mechanism. Yet another deficiency common in the prior art devices and practices is their obvious inability to be manufactured and sold at a relatively inexpensive price. Still another shortcoming attendant with the prior art devices such as that disclosed in the Hilty U.S. Pat. No. 4,673,153 is the preponderance for such devices to be incapable of deploying a plurality of hats in any desired attitude ranging from a substantially vertical to horizontal positions and any angular positions therebetween.

Therefore, it has long been known that it would be desirable to have a clothing suspension apparatus capable of deploying a cap in any desired attitude for the purpose of exposing the brow portion thereof for display and which is capable of performing a variety of other useful functions, the device being both inexpensive to manufacture and to sell and capable of relatively easy usage and installation.

OBJECTS AND SUMMARY OF THE INVENTION

Therefore it is an object of the present invention to provide an improved apparatus for suspending an article of clothing and the like.

Another object of the present invention is to provide an apparatus which is operable to obtain the benefits to be derived from prior art clothing suspension apparatuses while avoiding the detriments individually associated therewith.

Another object of the present invention is to provide an apparatus having a cap engagement assembly with dependent legs which are adapted to slideably engage and thereafter deploy a cap in any selected attitude.

Another object of the present invention is to provide a clothing suspension apparatus which is adapted to capture a button affixed on the crown of a cap and which can be detachably secured in capturing relation thereto.

Another object of the present invention is to provide a clothing suspension apparatus which is rotatably affixed to a suitable support member for easy deployment in any number of different environments and any desired position.

Another object of the present invention is to provide a clothing suspension apparatus which is operable to permit the deployment of a multiplicity of caps in juxtaposed relation for purposes of display.

Another object of the present invention is to provide a clothing suspension apparatus which is characterized by ease of deployment, simplicity of construction, and which can be sold at a nominal price.

Further objects and advantages are to provide improved elements and arrangements thereof in an apparatus for the purposes described which is dependable, economical, durable, and fully effective in accomplishing its intended purposes.

These and other objects and advantages are achieved in a clothing suspension apparatus of the present invention and which is operable for supporting a cap having a button affixed on the crown thereof and including a support member; and a cap engagement assembly is fastened on the support member and includes a pair of legs spaced a predetermined distance apart to define a channel which is adapted slidably to receive the button of the cap therebetween and which is operable for supporting the cap, the cap engagement assembly being rotatable with respect to the support member such that the cap may be supported in a plurality of angular orientations relative to the support member.

DESCRIPTION OF THE PREFERRED EMBODIMENTS

First Form

Figure 1:
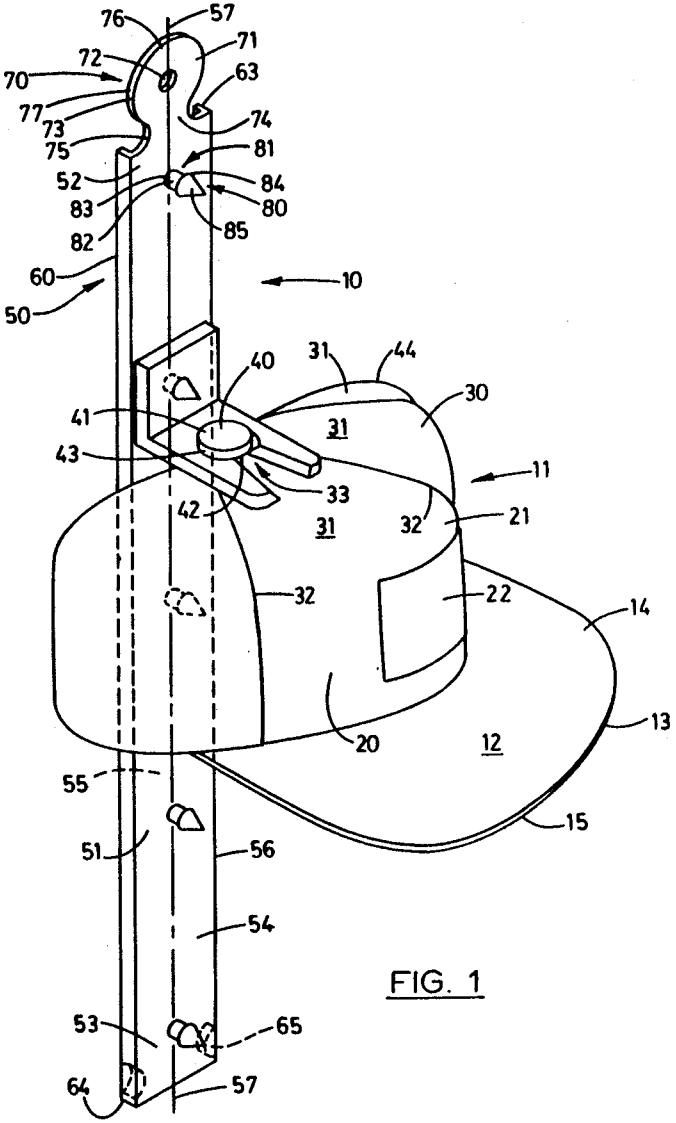
FIG. 1 is a perspective, environmental view of the first form of the present invention and showing the support member disposed in a substantially vertical orientation relative to an associated cap.

Referring more particularly to the drawings, the first form of the apparatus embodying the principles of the present invention is designated generally by the numeral 10 in FIG. 1. As shown therein, the apparatus is operable to deploy an appropriate cap or hat 11 in any selected attitude relative to an accompanying support member which will be discussed in greater detail hereinafter.

For illustrative convenience only, the clothing suspension apparatus is shown and described herein, as it would be configured if it was installed in a private residence. However, it should be understood that the apparatus can be deployed in a variety of different settings for purposes of commercial exploitation or for mere display.

The cap 11 has a brim or visor 12. The brim has a marginal edge 13, a top surface 14 and a correspondingly opposed bottom surface 15. The brim is preferably constructed of a flexible material which has a lightweight fabric stretched thereover, such as cotton, nylon or the like. The cap 11 has a brow which is generally indicated by the numeral 20. The brow of the cap has a central portion 21 upon which it has been customary to print a suitable advertising logo or message, or as illustrated in FIG. 1 suitably affixed a patch like device, herein indicated by the numeral 21. As can best be imagined by a study of FIG. 1 it should be understood that the cap is folded inwardly in a predetermined manner to allow it to be appropriately deployed.

The cap 11 has a crown portion 30. The crown portion is composed of several panels of lightweight fabric or fabric-like material 31 which have been cut to an appropriate shape and thereafter joined together at several seams 32. The several seams converge at an intersection point 33 which is substantially centrally located on the crown portion.

Joining the several converging panels of materials 31 together at the intersection point 33 is a button which is generally indicated by the numeral 40. The button is of conventional design having a top surface 41 and an opposed bottom surface 42. The button has a circumscribing edge generally indicated by the numeral 43. Further and as best seen by FIG. 1 and when the cap is appropriately folded as illustrated therein the crown portion thereof forms a rearwardly disposed folded edge of material 44 which may be received in one form of the invention, and which will be discussed in greater detail hereinafter.

The apparatus 10 of the subject invention is supported on a wall or other similar structure, not shown, by a support member which is generally indicated by the numeral 50. The support member 50 has a main body 51 which includes a first end 52 and an opposite, second end 53. Further, the main body has a top surface 54, bottom surface 55 and a peripheral edge 56. As best seen in FIG. 1 the support member is narrowly rectangular and has a longitudinal axis which is generally indicated by the line labelled 57.

Extending generally normally outwardly relative to the bottom surface 55 is a pair of flange members which are generally indicated by the numeral 60. The flange members each have inwardly and outwardly facing surfaces 61 and 62 and further have opposite first and second ends 63 and 64, respectively. As best illustrated by reference to FIG. 1 a pair of semicircular or cam-like projections 65 are individually mounted in close proximity to the second end 64 of the inwardly facing surfaces 61. The projections have an engagement surface which is generally indicated by the numeral 66. The projections 65 define a narrow passageway or female receiving station 67 therebetween.

Figure 2:
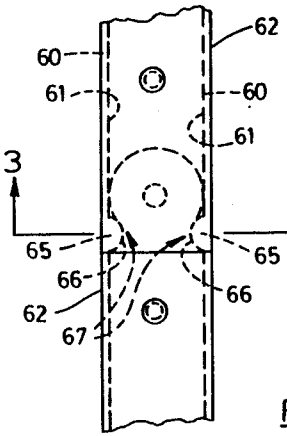
FIG. 2 is a fragmentary, plan view of the first form of the clothing suspension apparatus which is illustrated in FIG. 1, and showing some underlying structures in hidden lines.

Referring more particularly to FIG. 1 a lug, male portion, or connector assembly, and which is generally indicated by the numeral 70 is made integral with the first end 52 of the support member 50. The connector assembly has a main body 71 which has formed therein a substantially centrally disposed aperture 72 of predetermined dimensions. The aperture may receive a nail or other fastener which permits the support member to be suspended from a wall or other support (not shown). The main body further is defined by a peripheral edge 73. The main body 71 is connected to or made integral with the first end 52 of the support member 50 by a neck portion 74 of reduced dimensions. The neck portion is defined by engagement surfaces 75 which are substantially arcuately, or concavely shaped. This is best illustrated by reference to FIG. 2. As should be understood, the distance between the arcuately shaped engagement surfaces 75 is substantially equal to the width of the passageway 67 which is defined between the engagement surfaces 66. This permits the connector assembly 70 to matingly engage the second end 53 of an adjoining support member 50 in interfitted and mating relation as best shown in FIG. 2 thereby joining the two support members in substantially coaxial end-to-end relation. The connector assembly 70 further has a top surface 76 and an opposed bottom surface 77.

Figure 4:
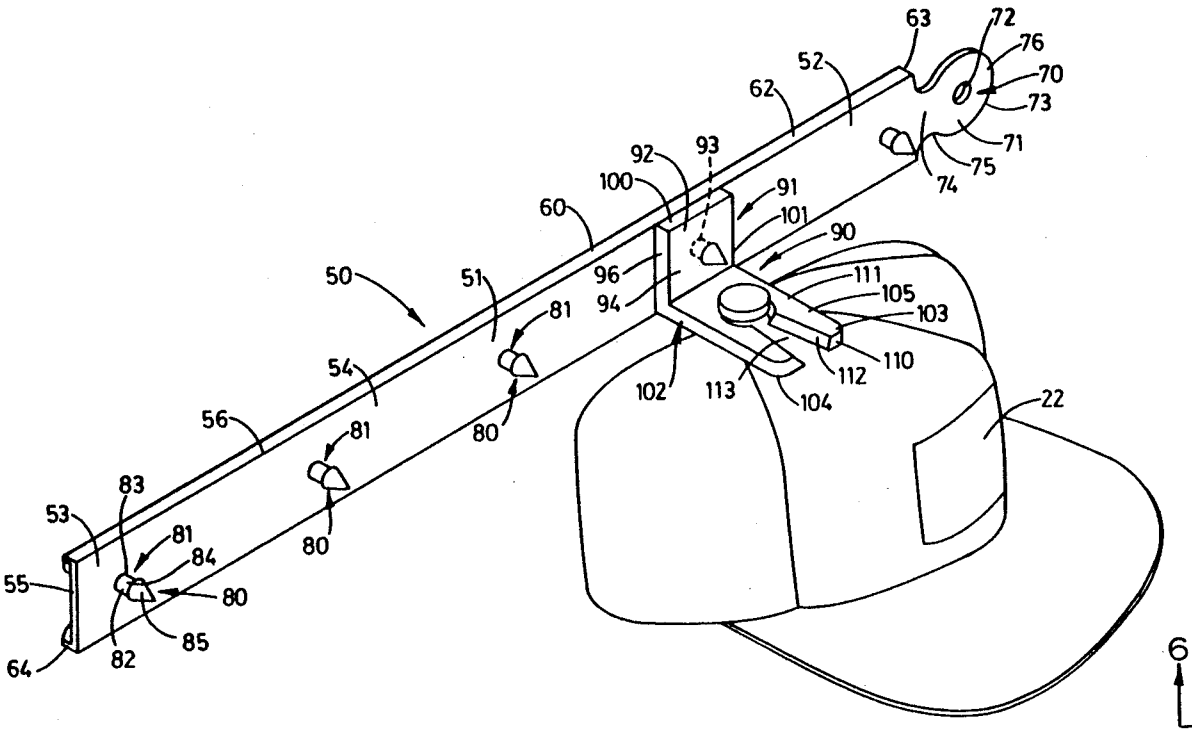
FIG. 4 is a perspective, environmental view of the first form of the present invention and showing the support member disposed in a substantially horizontal orientation relative to an associated cap.

As best seen by reference to FIGS. 1 and 4, the first form of the present invention 10 includes a plurality of posts which are generally indicated by the numeral 80 and which are secured on or made integral with the top surface 54 of the main body 51 as by molding or by other suitable fastening techniques. The plurality of posts include a main body 81 which has a cylindrically shaped shaft portion 82 having a predetermined cross-sectional dimension and which has a proximal end 83 which is fastened on the top surface 54 of the main body, and a remote, distal end 84, which has fixed thereto a substantially conically shaped head portion 85. The conically shaped head 85 has a base portion which has a diametral dimension which is greater than the cross-sectional dimension of the accompanying shaft. The operation of the individual posts will be discussed in greater detail hereinafter. Further, the individual posts are disposed in substantially equally spaced relation along the top surface and substantially along the longitudinal line of reference 57. This is best seen by reference to FIG. 1.

Figure 5:
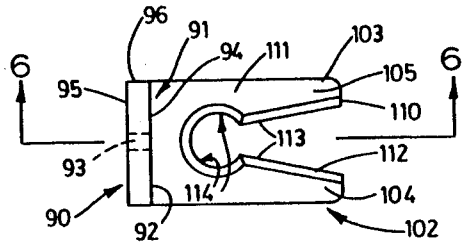
FIG. 5 is a top plan view of the first form of the cap engagement member of the present invention.
Figure 6:
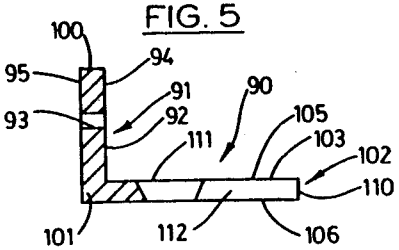
FIG. 6 is a longitudinal, vertical, sectional view taken from a position along line 6—6 of FIG. 5.

As best understood by a study of FIGS. 1 and 4 the apparatus 10 of the subject invention includes a cap engagement member which is generally indicated by the numeral 90 and which is operable for rotatable movement relative to the support member 50 thereby positioning the individual hats or caps 11 in any desired position for display or other purposes. The cap engagement member has an attachment member which is generally indicated by the numeral 91 and which includes a substantially planar main body 92 which has formed substantially centrally thereof an aperture 93 of predetermined dimensions. The aperture 93 has a diametral dimension which is slightly less than the diametral dimension of the base of the conical shaped head portion 85 of the post members 80 which were earlier discussed. As best illustrated by reference to FIGS. 1 and 4 the aperture allows passage of the conical shaped head portion 85 therethrough thereby effecting a snap-fit which permits the cap engagement member 90 to freely rotate about the cylindrically-shaped shaft portion 82. This is best imagined by a study of FIGS. 1 and 4 respectively. The snap-fit is effected by a deforming or enlargement of the aperture 93. The cap engagement member 90 further has a front surface 94 and a opposite, rear surface 95. In addition to the foregoing the planar main body 92 is defined by a peripheral edge 96. The attachment member 91 has a first or upper end 100 and a second or lower end 101. Extending generally normally outwardly relative to the second end 101 are a pair of dependent legs which are generally indicated by the numeral 102 and which include first and second legs 103 and 104, respectively. The individual legs each have a top surface 105 and an opposite bottom surface 106. Further, each of the legs have a leading portion 110 and a trailing portion 111. As best illustrated by reference to FIG. 5, the pair of dependent legs 102 each have edge-like internal surfaces which are designated by the numeral 112 and which define a generally U-shaped slot 113. The U-shaped slot terminates in a diminishing annular bore 114. As should be understood, and in some forms of the invention, the legs may not have the edge-like internal surfaces as discussed above, or define a diminishing bore. Rather, the legs will be substantially uniform in their cross-sectional and transverse dimensions. The pair of dependent legs are dimensioned slidably to receive and capture the button 40 in substantially fixed relationship between the dependent legs. When properly employed the cap engagement member 90 is deployed between the cap's crown and the bottom surface 42 of the button which is affixed on the cap's crown. Upon reference to FIG. 5 it will be seen that the pair of dependent legs 102 converge to form the diminishing bore which is formed substantially centrally of the pair of dependent legs 102. The annular bore is dimensioned suitably to receive and capture the button affixed on the crown of the cap 11. It should be appreciated that the overall length of the dependent legs is somewhat dependent upon the support member 50 upon which it is mounted. Those skilled in the art should recognize therefore, that in the event that the apparatus was deployed from, for example, surfaces other than that shown, the dependent legs could be somewhat longer, or shorter in length than that depicted in the attached figures.

Second Form

Figures 7, 8, 9, 13, 14:
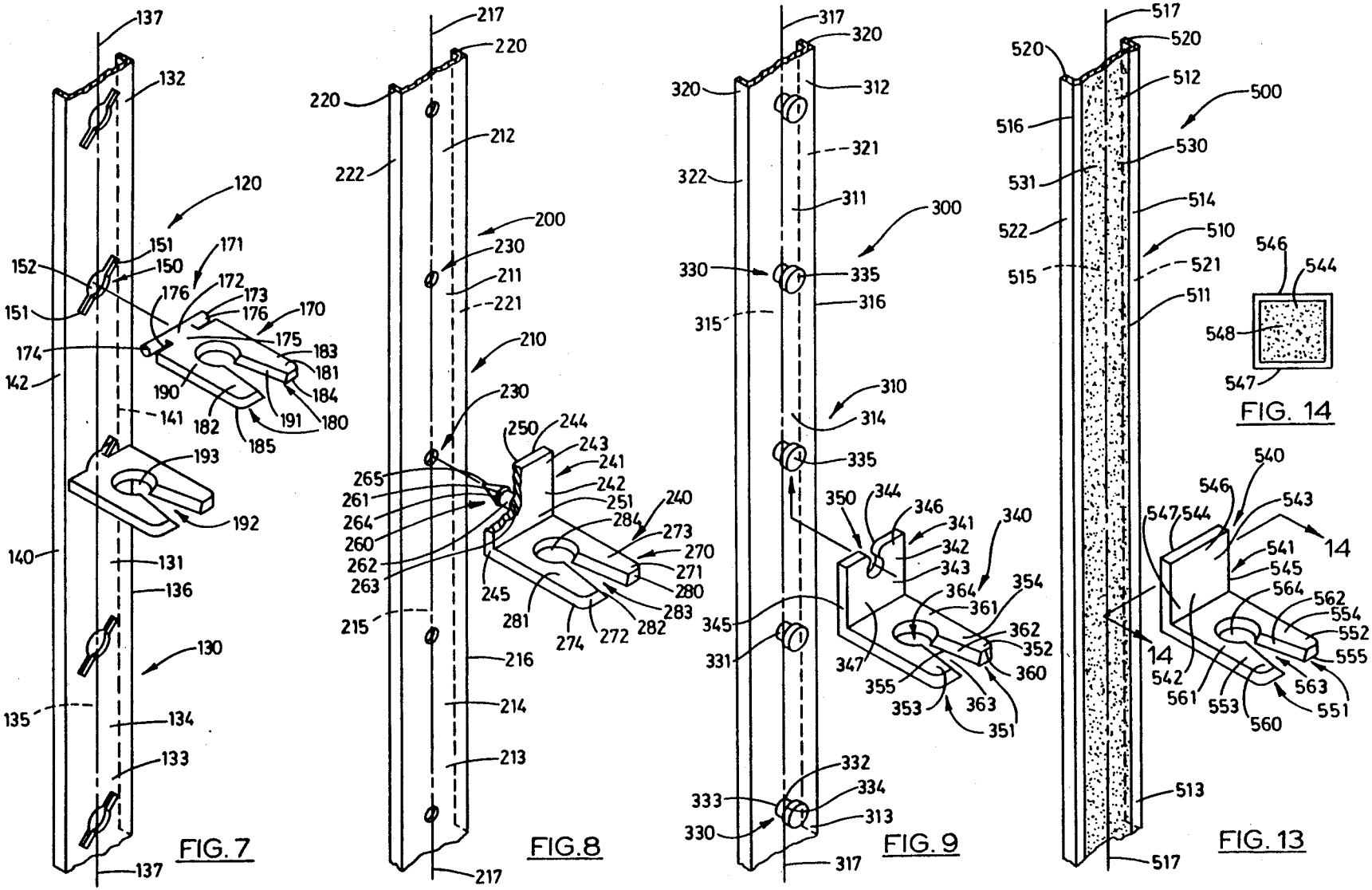
FIG. 7 is a fragmentary, perspective view of a second alternate form of the present invention.
FIG. 8 is a fragmentary, perspective view of a third alternate form of the present invention.
FIG. 9 is a fragmentary, perspective view of a fourth alternate form of the present invention.
FIG. 13 is a fragmentary, perspective view of a sixth alternate form present invention.
FIG. 14 is a rear elevation view of the cap engagement member taken from a position along line 14—14 of FIG. 13.

The second form of the invention is generally indicated by the numeral 120 in FIG. 7. As shown therein the apparatus of the second form of the subject invention includes a support member 130 which is similar in its overall operation to that shown in FIG. 1 however, the support member 130 has some important features which are somewhat different from that shown in FIG. 1, and therefore it will be discussed in the text which follows. The support member 130 has a main body 131 which includes first and second ends 132 and 133, respectively. Further the support member has top and bottom surfaces 134 and 135, and the top surface is defined by a peripheral edge 136. Further the support member 130 includes a longitudinal axis which is generally indicated by the numeral 137. As should be understood, the main body 131 has a predetermined thickness dimension which is defined between the top and bottom surfaces, the importance of which will be discussed in greater detail hereinafter. The main body further includes a pair of flange members 140 which have inwardly and outwardly facing surfaces, and which extend generally normally outwardly relative to the bottom surface 135. As should be understood the support member 130 includes those features of the support member 50 which were earlier discussed, but which are not shown herein. These features include a connector assembly or lug 70 and projections 75 which allow the support member 130 to releasably interconnect in substantially coaxial alignment with an adjoining support member of similar construction. For purposes of brevity, therefore it should be understood that the connector assembly as well as these projections are component parts of the support member 130 but are not shown in FIG. 7. As best seen in FIG. 7 and formed in the main body 131 at predetermined distances along the top surface 134 are a plurality of apertures which are generally indicated by the numeral 150. Each of the apertures 150 include a pair of substantially coaxial aligned and radially extending keyways 151 which have a predetermined longitudinal dimension. Moreover, the centrally disposed aperture has a central portion 152 having a predetermined diametral dimension.

The second form of the invention 120 includes a cap engagement member and which is generally indicated by the numeral 170. The cap engagement member has an attachment member which is generally indicated by the numeral 171 and which has an elongated main body 172. The elongated main body has first and second ends 173 and 174 and a predetermined longitudinal dimension which is just slightly less than the length dimension between the pair of coaxially aligned and radially extending keyways 151. This, of course, permits the attachment member 171 to be slidably received through the keyway as best illustrated by reference to FIG. 7. Further, the elongated main body is affixed on the cap engagement member 170 by a narrow support member 175 which extends substantially longitudinally outwardly relative to the cap engagement member 170. The narrow support member has a transverse or width dimension which is generally less than the diametral dimension of the central portion 152 of the aperture 150. Moreover a pair of gaps are defined between the elongated main body and the cap engagement member. The gaps have a dimension which is just slightly greater than the thickness dimension of the main body 131 of the support member. In operation, it should be understood the elongated main body 172 is aligned with the keyways and then slidably received therethrough. Then, by rotatable movement of the cap engagement member 170, either in the clockwise or counterclockwise direction, the main body 131 of the support member is slideably received in the gaps defined between the cap engagement member and the elongated main body 172 thereby capturing the main body 131 therein. This, of course, secures, or engages the cap engagement member 170 in a friction-fit relationship relative to the support member 130. As should be understood the cap engagement member may be rotated to any position other than a position in substantially coaxial alignment with the keyway thereby supporting a cap 11 in any desired attitude relative to the support member 130.

The cap engagement member 170 also includes a pair of dependent legs 180 which include a first leg and a second leg 181 and 182, respectively. The pair of dependent legs have top and bottom surfaces, 183, and 184 as well as leading and trailing portions 185 and 190, respectively. Moreover, each of the legs include edge-like internal surfaces 191 which define a U-shaped slot. The U-shaped slot terminates in a diminishing annular bore 193. The operation of the dependent legs are substantially identical to that which was described in the first form of the invention and therefore for purposes of brevity is not discussed in further detail herein.

Third Form

The third form of the invention is generally indicated by the numeral 200 in FIG. 8. As should be understood, the third form of the invention operates in a manner substantially similar to that shown in FIG. 7 with the exception of the features which will be discussed in greater detail hereinafter. The third form of the invention 200 is supported for rotatable movement relative to a supporting surface (not shown) by a support member which is generally indicated by the numeral 210. The support member 210 has a main body 211 having opposite first and second ends 212 and 213 respectively. The main body includes a top surface 214, and an opposite bottom surface 215, and is further defined by a peripheral edge 216. The main body has a longitudinal axis which is generally indicated by the line labelled 217. Extending substantially normally rearwardly relative to the bottom surface 215 are a pair of flange members 220 which have inwardly and outwardly facing surfaces 221 and 222, respectively. Formed into the top surface 214 at predetermined locations are a plurality of apertures 230 which have predetermined diametral dimensions.

As best imagined by a study of FIG. 8 it should be understood that the support member of the present form of the invention has features similar to the support member 50 which was discussed in detail earlier in the specification. That is, it has a connector assembly as well as projections which are operable to provide a means by which two adjoining support members may be disposed in substantially coaxial alignment and engagement one with the other. Therefore for purposes of brevity these structures are not discussed in further detail herein.

A cap engagement member, and which is generally indicated by the numeral 240, is operable to support a cap 11 (not shown) in supported rotatable relation relative to the support 210. More particularly, the cap engagement member has an attachment member 241 which is formed of a substantially planar main body 242 which has a front surface 243 and an opposite rearwardly facing surface 244. The planar main body 242 is defined by a peripheral edge 245. The planar main body 242 has a first end 250 and a second end 251. Extending substantially normally outwardly relative to the rear surface 244 is a post which is generally indicated by the numeral 260. The post has a main body 261 which includes a cylindrically shaped shaft 262, and which has a predetermined length dimension which is slightly greater than the thickness dimension of the main body 211. The cylindrically shaped shaft further has a first end 263, which is fastened on the rearwardly disposed surface, and a distal end 264 which is remote thereto. Mounted on the distal end 264 is a conically-shaped head 265 which has a base portion which has a diametral dimension which is greater than the diametral dimension of the aperture which is formed in the main body. As should be understood, and in operation, the cap engagement member, and more particularly, the conically-shaped head portion thereof is forced through the aperture and the post is thus captured for rotatable movement relative to the support member in the manner of a snap-fit. Affixed on and extending substantially normally outwardly relative to the second end 251 of the attachment member is a pair of dependent legs 270. The pair of dependent legs include first and second legs 271 and 272 and which have top and bottom surfaces 273 and 274, respectively. Moreover, and as was similarly discussed with respect to the earlier forms of the invention, the first and second legs have leading and trailing portions 280 and 281 and further include edge-like internal surfaces 282 which define a U-shaped slot which terminates in a diminishing annular bore 284. The cap engagement member 240 operates in a manner similar to those forms of the invention previously discussed and therefore for the sake of brevity is not discussed in further detail herein.

Fourth Form

The fourth form of the present invention is generally indicated by the numeral 300 in FIG. 9. As shown therein, the fourth form of the invention includes an elongated support member which is generally indicated by the numeral 310 and which includes a main body 311 having opposite first and second ends 312 and 313 respectively, and which is further defined by a top surface 314 and an opposite bottom surface 315. The support member 310 is further defined by a peripheral edge 316 and includes a longitudinal axis which is also generally indicated by the line labelled 317. As best seen in FIG. 9 a pair of flange members 320 extend substantially normally rearwardly relative to the bottom surface 315 and further include inwardly and outwardly facing surfaces 321 and 322, respectively. Mounted on the top surface 314 and disposed in predetermined positions along the longitudinal axis of the support member 310 are a plurality of posts which are generally indicated by the numeral 330. The individual posts include a main body 331 which has a cylindrically shaped shaft portion 332. The shaft portion has a proximal end 333 which is affixed on the top surface 314 and a distal end 334 which is remote thereto. As illustrated, a button-like head is affixed to or made integral with the distal end 334 of the main body and has a diametral dimension which is greater than the cross-sectional or diametral dimension of the accompanying cylindrically shaped shaft portion 332.

In addition to the foregoing the fourth form of the invention includes a connector assembly and projections (not shown) which allow a support member to be releasably joined in end-to-end relation with an adjoining support member of similar construction.

A cap engagement member which is operable to releasably engage and thereafter rotate about the shaft portion 332 is generally indicated by the numeral 340. The cap engagement member includes an attachment member 341 which has a main body 342 including front and rear surfaces 343 and 344 respectively and which is further defined by a peripheral edge 345. In addition to the foregoing, the main body has opposite first and second ends 346 and 347, respectively. As best seen in FIG. 9, an aperture 350 of predetermined dimensions is formed in the first end 346 and is disposed in close proximity to the peripheral edge 345 thereof. The aperture includes a diminishing dimensioned slot which communicates with the outside peripheral edge and which provides a means by which the cylindrically shaped shaft may pass into the aperture as in the nature of a snap-fit. As should be understood the dimension of the diminishing slot is somewhat slightly less than the cross-sectional dimension of the shaft portion 332. Therefore, and in order to pass through the diminishing slot the main body 342 of the cap engagement member must deform thereby allowing the shaft to pass therethrough and thus be captured in the aperture 350 in the manner of a snap-fit. As should be understood, the cap engagement member is operable to rotate freely to any desired position about the shaft portion 332. The cap engagement member further has a pair of dependent legs 35 which extend substantially normally outwardly relative to the second end 347 of the main body. The pair of dependent legs include first and second legs 352 and 353 respectively. The individual legs have top and bottom surfaces 354 and 355 and further have leading and trailing portions 360 and 361 respectively. The individual legs have edge-like internal surfaces 362 which define a generally U-shaped slot which terminates in an annular bore 364. As earlier discussed the cap engagement member operates in a manner similar to that which was discussed with respect to the first form of the invention and therefore for purposes of brevity is not discussed in further detail herein.

Fifth Form

Figure 11:
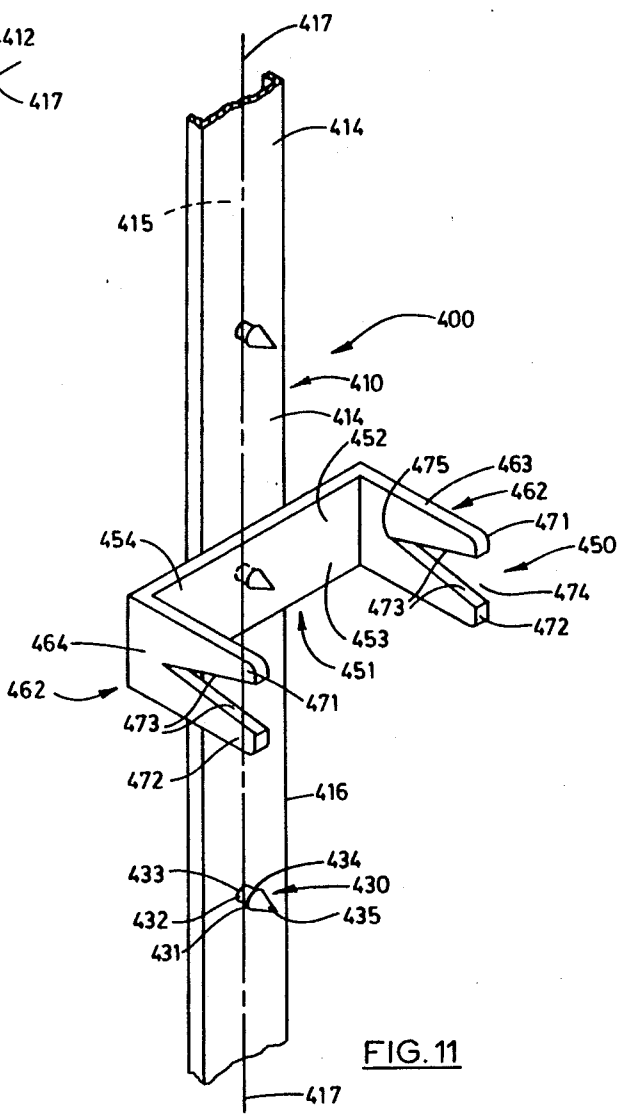
FIG. 11 is a fragmentary, perspective view of the fifth alternate form of the present invention and showing the support member disposed in a substantially vertical orientation.
Figure 10:
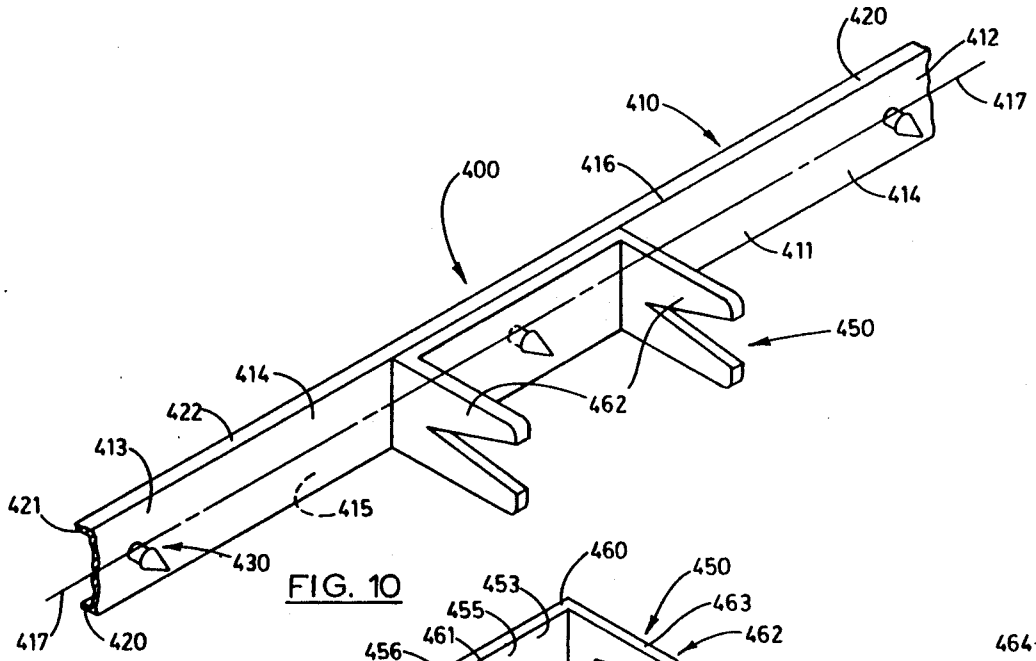
FIG. 10 is a fragmentary, perspective view of a fifth alternate form of the present invention and showing the support member thereof disposed in a substantially horizontal orientation.
Figure 12:
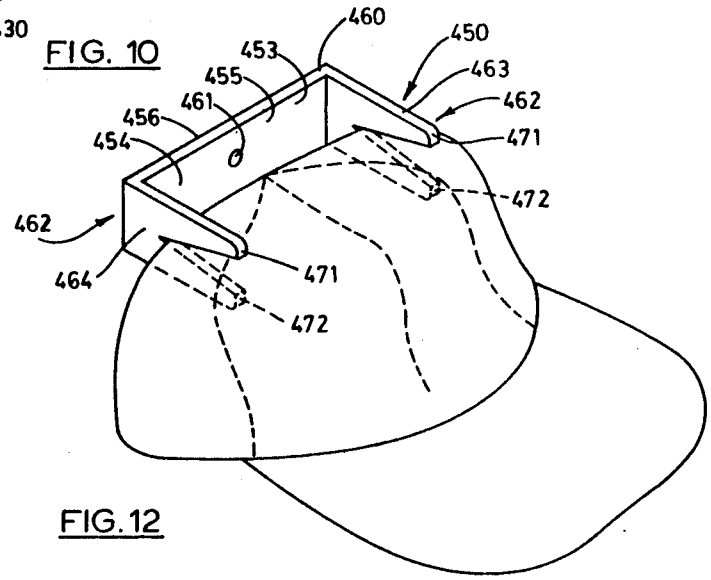
FIG. 12 is a fragmentary, perspective view of the cap engagement member of the fifth alternate form of the invention.

The fifth form of the present invention is generally indicated by the numeral 400 and is best understood by a study of FIGS. 10, 11, and 12, respectively. The fifth form of the present invention includes a support member 410 which has a main body 411 and opposite first and second ends 412 and 413, respectively. The support member is defined by top and bottom surfaces and by a peripheral edge 414, 415, and 416, respectively. Furthermore, the support member has a longitudinal axis which is generally indicated by the numeral 417. As should be understood, the fifth form of the invention also includes means by which the main body may be mounted in end-to-end, substantially coaxial and interlocking relation as was discussed in greater detail with respect to the first form of the invention. However, and for purposes of brevity these structures are not illustrated and discussed in further detail herein. The support member 410 includes flange members 420 which are disposed along the peripheral edge 416 and which extend substantially normally rearwardly relative to the bottom surface 415. The individual flanges have inwardly and outwardly facing surfaces 421 and 422.

Mounted substantially along the longitudinal axis 417 and disposed in predetermined spaced relation along the top surface 414 are a plurality of posts which are generally indicated by the numeral 430. The individual posts include a main body 431 which has a cylindrically shaped shaft 432, and which further has a proximal end 433 which is affixed on the top surface 414 and an opposite distal end 434 which is disposed remotely thereto. Mounted on the distal end 434 is a conically shaped end portion 435 having a base having a diametral dimension which is greater than that of the cylindrically shaped shaft 432. A cap engagement member is generally indicated by the numeral 450 and has an attachment member 451 which is substantially planar and rectangular in its overall shape. The attachment member has a main body 452 having opposite first and second ends 453 and 454, respectively, and front and rear surfaces 455 and 456, respectively. The main body 452 is further defined by a peripheral edge 460. Mounted substantially centrally of the main body 452 is an aperture 461 which has a diametral dimension which is just slightly greater than the diametral dimension of the cylindrically shaped shaft 432 but less than the diametral dimension of the base portion of the conically shaped head portion 435. As should be understood, the conically shaped head would be forced through the aperture thereby deforming it and the main body would then be captured about the shaft in a snap-like fit. Mounted on the first and second ends 453 and 454 of the main body and extending substantially normally outwardly relative to the front surface 455 are engagement portions 462 which include a first portion 463 and a second portion 464, respectively. Each of the portions has a pair of legs 470 which include first and second legs 471 and 472, respectively. Each pair of legs are disposed in substantially similar angular relationships relative to the main body. The individual legs have inside peripheral edges 473 which define a gap 474 of predetermined dimensions. The gaps are substantially coaxially aligned, and each gap terminates at an apex 475. As best seen by reference to FIG. 12 each gap is slidably dimensioned to receive and hold the rearwardly disposed edge of the crown 44 of the cap 11. In this fashion the brow portion 20 is disposed in an appropriate attitude for display.

Sixth Form

The sixth form of the invention is generally indicated by the numeral 500 in FIG. 13. The sixth form of the invention includes a support member which is generally indicated by the numeral 510 and which includes an elongated main body 511 which has opposite first and second ends 512 and 513, respectively. The main body is defined by top and bottom surfaces 514 and 515, respectively as well as by a peripheral edge 516 and a longitudinal axis which is generally indicated by the line labelled 517. As should be understood the support member which is shown fragmentarily in FIG. 13 is operable to be interconnected with an adjoining support member of similar construction in the fashion which was discussed in detail with respect to the first form of the invention and therefore for purposes of brevity is not discussed in further detail herein. The support member includes a pair of flange members 520 which are disposed along the peripheral edge and which extend substantially normally outwardly relative to the rearward surface thereof. The flange members further include inwardly and outwardly facing surfaces 521 and 522 respectively. As best seen in FIG. 13 a suitable hook and loop type fabric such as Velcro® is fastened, using a suitable fastening technique, such as by employing a suitable adhesive on the top surface 514 of the main body. The hook and loop type fabric 530 extends along the length of the top surface and further includes an outwardly facing surface 531.

A cap engagement member and which is generally indicated by the numeral 540, is operable to releasably engage the support member and is further capable of being positioned in various positions relative to the longitudinal axis 517 of the support member 510 thereby displaying an associated cap 11 in any desired position relative to the support member. More particularly, the cap engagement member 540 has an attachment member 541 including a main body 542 that has front and rear facing surfaces, and which is defined by a peripheral edge 545. Further the cap engagement surface has opposite first and second ends 546 and 547, respectively. Mounted on the rearwardly facing surface 544 of the main body is a suitable mating portion of hook and loop-type fabric 548 which is compatible with and which can releasably engage the hook and loop fabric 530 which is mounted on the main body 511 of the support member 510. As should be understood and when the rearwardly disposed surface 544 is pressed into engagement with the support member 510 the hook and loop fabrics 530 and 548 engage one another thereby positioning the cap engagement member in any desired location relative to the longitudinal axis 517. The cap engagement member 540 further includes a pair of dependent legs 551 which are fixed on the second end 547 of the main body 542 and which extend substantially normally outwardly relative thereto. The pair of dependent legs include first and second legs 552 and 553, respectively which have top and bottom surfaces 554 and 555 as well as leading and trailing portions 560 and 561, respectively. The first and second legs have inwardly facing edge-like internal surfaces 562 which define a U-shaped slot 563. The U-shaped slot terminates in a diminishing annular bore 564 which is disposed substantially centrally of the pair of dependent legs 551.

OPERATION

Figure 3:
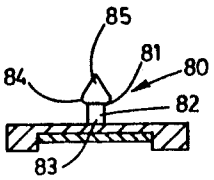
FIG. 3 is a somewhat enlarged transverse, vertical sectional view taken from a position along line 3—3 of FIG. 2.

The operation of the described embodiments of the subject invention are believed to be readily apparent and are briefly summarized at this point. The apparatus of the subject invention for suspending an article of clothing such as a cap is best illustrated by references to FIGS. 1, 7, 8, 9, 10, 11, and 13, respectively. With respect to the first form of the invention 10, the apparatus includes a support member 50 which is herein illustrated as an elongated, substantially rectangular shaped shaft. As best seen by reference to FIG. 1, a multiplicity of posts 80 are mounted in predetermined, substantially equally spaced locations along the main body 51 and are operable to engage individual cap engagement members 90 in the manner of a snap-fit, as earlier discussed. It should be understood this arrangement permits the individual cap engagement members to freely rotate about the individual posts 80 in a manner whereby the individual caps may be displayed from any position from the horizontal to a substantially vertical position, and any locations therebetween. Further, and as earlier discussed in greater detail, a connector assembly 70 is made integral with the first end 52 of the main body and is operable to position individual support members in substantially coaxial alignment, one with another, such that the individual support members may be made into a substantially continuous support member. This is best illustrated by reference to FIGS. 2 and 3, respectively. It should be understood that the connector assembly 70, as well as the projections 65, which are positioned on the second end 64 of the flange members 60, are present in the remaining forms of the invention although they are not shown in the drawings which are fragmentary views of same.

The apparatus 10 of the first form of the invention has a cap engagement member 90 which includes a pair of dependent legs 102 which further define a diminishing and substantially U-shaped slot 113. The U-shaped slot is suitably dimensioned to slidably receive a button 40 that is affixed on the crown 30 of the cap 11. As best understood by reference to FIG. 1, the bottom surface 42 of the button lies in contact with the top surface 105 of the pair of dependent legs. Thus, it should be apparent that the dependent legs are slidably received between the bottom of the button and the crown of the cap. This permits the apparatus 10 to securely hold the cap which is suspended therefrom.

The second form of the invention 120 operates in a manner substantially similar to the first form of the invention, that is, the apparatus 120 is operable to permit a multiplicity of caps 11 to be displayed in a number of positions from a substantially horizontal position to a vertical position relative one to the other. However, and in the second form of the invention, the means for rotatably securing the cap engagement member 170 is somewhat slightly different. More particularly, and as best seen by reference to FIG. 7 the support member 130 includes a plurality of apertures 150 which are disposed in a fashion whereby the cap engagement member 130 may engage the support member and be rotated relative thereto. In particular, the individual apertures 150 include a pair of radially extending keyways 151 which are dimensioned to receive an attachment member 171 which has an overall length dimension which is somewhat slightly less than the length of both the keyways. Further, and when rotated in either direction, a pair of gaps 176, which are defined between the elongated main body 172 and the pair of dependent legs 180, are operable to receive the main body 131 of the support member 130 thereby securely positioning the cap engagement member 170 on the support member 130. As should be understood, the pair of dependent legs 180 operate in a manner substantially identical to the first form of the invention and therefore for purposes of brevity, is not discussed in further detail herein.

The third form of the invention and which is indicated by the numeral 200 in FIG. 8, includes a support member 210 which has a main body 211 and which has formed therein a plurality of aperatures 230. The cap engagement member 240 includes a post 260 which is operable to be received into one of the apertures thereby positioning the cap engagement member 240 in rotatable mating relation relative to the support member 210. As should be understood the post is received through the aperture and thereby causes the cap engagement member to be freely rotatable about the post thus allowing the cap engagement member 240 to suspend a cap 11 in any desired location. As should be understood the pair of dependent legs 270 operate in a manner substantially identical to the first form of the invention and therefore for the sake of brevity is not discussed in further detail herein.

The fourth form of the invention 300 is shown at FIG. 9 and includes a support member 310 which has mounted along its main body 311 a plurality of posts 330. Further, a cap engagement member 340 includes an attachment member 341 which has formed therein an aperture 350 which includes a slot of diminished dimension which permits movement of the post therethrough and into the aperture. This snap-fit arrangement releasably secures the cap engagement member for rotatable movement relative to the individual posts thereby allowing the cap engagement member to suspend an associated cap 11 in any desired location. It should be understood that the pair of dependent legs 351 operate in a manner substantially identical to that which was described with respect to the first form of the invention 10 and therefore, for purposes of brevity, is not discussed in further detail herein.

The fifth form of the invention, and which is generally indicated by the numeral 400 in FIG. 10 includes a support member 410 which has fixed along its main body 411 a plurality of posts 430. Further a cap engagement member and which is generally indicated by the numeral 450 has an attachment member 451 which has formed therein an aperture 461 which permits passage of the post therethrough in the manner of a snap-fit. The cap engagement member has engagement portions 462 which individually include a pair of legs which are operable to receive the rearwardly disposed edge 44 of the cap 11 in a folded fashion as best illustrated in FIG. 12. As should be understood, the cap engagement member of the fifth form of the invention is rotatable about the post thereby allowing the cap 11 to be positioned in any position from the vertical to the horizonal relative to an adjoining cap 11.

The operation of the sixth form of the invention 500 is best understood by a study of FIG. 13. As shown therein the support member 510 has fixed thereto a hook and loop-type fabric 530, and the cap engagement member 540 has an attachment member 541 which further has attached thereto a mating portion of hook and loop fabric 548 which is operable to releasably engage the hook and loop-type fabric 530. As should be understood the cap engagement member 540 is operable to be positioned in any attitude relative to the support member and is thus capable of suspending the cap 11 for purposes of display in positions which range from the vertical to the horizontal. Further the hook and loop fabric permits the spacing of the individual cap engagement members to be varied such that the user of the apparatus may achieve any desired visual effects with the caps 11. Furthermore, it should be understood that with respect to all forms of the invention that a user of the present device may selectively position cap engagement members at predetermined spaced intervals as determined by the number of posts or apertures (depending on the form of the invention) which are made integral with an associated support member to achieve any desired spacing. Moreover, and while in all forms of the invention a unitary support member was shown it should be understood that the support member may be fragmented thereby providing individual rotatable cap engagement member which then may be secured to a wall or the like by a screw type fastener or a suitable adhesive.

The various forms of the present invention can be adapted for installation on a wide variety of different support members as should be readily apparent from the discussion above. In addition the present form of the invention can be modified to permit its use on other surfaces such as on -a cylindrical support member or individually, on an accompanying wall for example. The apparatus is easily installed and maintained and can be manufactured at a nominal price as compared with other prior art devices used for similar purposes.

Although the invention has been herein shown and described in what is conceived to be the most practical and preferred embodiment, it is to be recognized that departures may be made therefrom within the scope of the invention which is not to be limited to the illustrative details disclosed.

Having thus described and illustrated our new invention what we claim as new and desire to secure by Letters Patent is:

1. A clothing suspension apparatus for supporting a cap having a button affixed on a crown thereof, comprising:

a support member having a longitudinal axis and opposite first and second ends, and wherein the first end is a male end and the second end is a female end, and wherein a plurality of support members may be connected in substantially coaxial alignment by releasably interconnecting the first end of one support member to the second end of an adjoining support member; and a plurality of cap engagement assemblies disposed in predetermined spaced relation substantially along the longitudinal axis of the support member, and wherein each of the cap engagement assemblies include a pair of legs which are spaced apart to define a channel which slidably receives the button of a cap therebetween for supporting the cap, the cap engagement assembly being rotatable with respect to the support member such that the cap may be supported in a plurality of angular orientations relative to the support member.

2. A clothing suspension apparatus as claimed in claim 1 and wherein the support member has a forwardly facing surface and a rearwardly facing surface, and wherein the cap engagement assemblies extend substantially normally outwardly relative to the forwardly facing surface, and wherein the first end of the support member terminates in a lug which has a neck portion of reduced dimension, and wherein a pair of detents are located at the second end of the support member and which face inwardly to form the female end, and wherein the neck portion of an adjoining cap suspension apparatus nests between the detents at the second end of the cap suspension apparatus in the manner of a snap-fit thereby connecting the individual support members in substantially coaxial alignment.

3. A clothing suspension apparatus as claimed in claim 2 and wherein the lug has an aperture formed therein to facilitate attachment of the apparatus to a wall or like surface by a fastening means which extends through the aperture of the lug.

4. A clothing suspension apparatus as claimed in claim 1 and wherein the legs have edge-like internal surfaces defining an inwardly convergent slot communicating with an annular bore, and wherein the legs are dimensioned to be slidably moved between the button and the crown of the cap and on opposite sides of an interconnection between the button and crown and into supporting relation to the cap for retaining the cap in supported relation on the support member for displaying a brow portion of the cap thereof.

5. A clothing suspension apparatus as claimed in claim 1 and wherein the support member and the cap engagement assembly are formed of a resilient plastic material.

6. A clothing suspension apparatus for supporting a cap having a button affixed on a crown thereof, comprising:

(a) a support member elongated along an axis and having first and second ends in opposition along the axis, the first end being a male end and the second end being a corresponding female end such that a plurality of cap suspension apparatuses of like construction may be connected by engaging the first end of one support member to the second end of another in series along the axis of the elongated support member; and (b) a plurality of cap engagement assemblies fastened on the support member in predetermined spaced relation apart along the axis of the support member, each of the cap engagement assemblies including a pair of legs which are spaced apart to define a channel which slidably receives the button of the cap therebetween for supporting the cap.

7. A clothing suspension apparatus as claimed in claim 6 and wherein each of the cap engagement assemblies are individually rotatable with respect to the support member such that the cap supported by the legs of a particular cap engagement assembly may be disposed in a plurality of angular orientations relative to the support member.

8. A clothing suspension apparatus as claimed in claim 6 and wherein the support member has forwardly and rearwardly facing surfaces, the cap engagement assemblies extending substantially normally outwardly from the forwardly facing surface, and the rearwardly facing surface having two parallel flanges which project outwardly therefrom, and wherein the first end of the support member terminates in a lug, and each of the flanges includes a detent which is located adjacent to the second end of the support member and which faces inwardly to form the female end therebetween, and wherein the male portion of one cap suspension apparatus nests between the detents at the second end of an adjoining apparatus in the manner of a snap-fit connecting the support members in series.

9. A clothing suspension apparatus as claimed in claim 8 and wherein the lug has an aperture formed therein which facilitates attachment of the apparatus to a wall or like surface by a fastening means which extends through the aperture of the lug.

10. A clothing suspension apparatus as claimed in claim 6 and wherein the legs have edge-like internal surfaces defining an inwardly convergent slot communicating with an annular bore, and the legs are dimensioned to be slidably moved between the button and the crown of the cap and on opposite sides of an interconnection between the button and the crown and into supporting relation relative to the cap for retaining the cap in supported relation on the support member for displaying a front portion of the cap thereof.

11. A clothing suspension apparatus and claimed in claim 6 and wherein the support member and the cap engagement assembly are formed of a resilient plastic material.

12. A clothing suspension apparatus for supporting a cap having a button affixed on a crown thereof, comprising:

(a) a support member having opposite first and second ends, and wherein a plurality of support members may be oriented in substantially coaxial alignment by substantially aligning the first end of one support member with the second end of an adjoining support member; and (b) at least one cap engagement assembly borne by the support member and including an attachment member which is disposed in juxtaposed relation relative to the support member and which has a pair of legs which extend outwardly therefrom and which are spaced apart to define a channel which slidably receives the button of the cap therebetween for supporting the cap, and wherein the cap engagement assembly is rotatable relative to the support member such that the cap may be supported in a plurality of angular orientations relative to the support member.

13. A clothing suspension apparatus as claimed in claim 12 and wherein the support member has a post which extends outwardly therefrom, and wherein the attachment member includes an aperture having a diametral dimension sufficient to slidably receive the post and thereby permit rotation of the cap engagement assembly about the post.

14. A clothing suspension apparatus as claimed in claim 13 and wherein the post terminates in a head portion having a cross-sectional dimension greater than the cross-sectional dimension of the post, and wherein the aperture has a diametral dimension less than that of the head portion, and wherein the passage of the head portion of the post through the aperture effects a snap-fit thereby rotatably attaching the cap engagement assembly on the support member.

15. A clothing suspension apparatus as claimed in claim 13 and wherein the post terminates in a head portion having a cross-sectional dimension greater than the cross-sectional dimension of the post, and wherein the aperture further has a diametral dimension less than that of the head portion, and the attachment member further has a slot which communicates with the aperture, and wherein the passage of the post through the slot effects a snap-fit thereby rotatably attaching the cap engagement assembly to the support member.

16. A clothing suspension apparatus as claimed in claim 12 and wherein the cap engagement assembly includes a post which extends substantially outwardly therefrom in a direction substantially opposite to the legs, and wherein the support member includes an aperture having a diametral dimension which slidably receives the post thereby allowing rotation of the cap engagement assembly about the post.

17. A clothing suspension apparatus as claimed in claim 16 and wherein the post terminates in a head portion having a cross-sectional dimension greater than the cross-sectional dimension of the post, and wherein the aperture has a diametral dimension less than that of the head portion, and wherein the passage of the head portion of the post through the aperture effects a snap-fit thereby rotatably attaching the cap engagement assembly on the support member.

18. A clothing suspension apparatus as claimed in claim 12 and wherein the support member has a keyway formed therein, and wherein the cap engagement member is operable to be received in the keyway thereby rotatably attaching the cap engagement assembly on the support member.

19. A clothing suspension apparatus as claimed in claim 12 and wherein the cap engagement assembly is fastened on the support member by a hook and loop-type fabric.

20. A clothing suspension apparatus for supporting a cap which is folded inwardly in a predetermined manner, comprising:

a support member; and a cap engagement assembly rotatably borne on the support member and including a main body which has opposite first and second ends, and wherein a pair of dependent legs are mounted on the first and second ends of the main body and are individually disposed in substantially similar angular relationships relative thereto, each pair of dependent legs being spaced apart to define respective channels therebetween, and wherein the respective channels are substantially coaxially aligned and are operable to slidably engage the folded portion of the cap for supporting the cap thereof.

21. A clothing suspension apparatus as claimed in claim 20 and wherein the support member has a cylindrical post which extends substantially normally outwardly therefrom, and wherein the attachment member further includes an aperture having a diametral dimension which accommodates the post thereby allowing rotation of the cap engagement assembly with respect to the support member.

22. A clothing suspension apparatus as claimed in claim 21 and wherein the post terminates in a head portion having a cross-sectional dimension greater than the cross-sectional dimension of the post, and wherein the aperture has a diametral dimension less than the cross-sectional dimension of the head portion, and wherein the passage of the head portion of the post through the aperture effects a snap-fit thereby rotatably attaching the cap engagement assembly on the support member.

* * * * *